US007186071B2

(12) United States Patent
Pascoe

(10) Patent No.: US 7,186,071 B2
(45) Date of Patent: Mar. 6, 2007

(54) VARIABLE FLOW WATER PUMP

(75) Inventor: David Mark Pascoe, Newmarket (CA)

(73) Assignee: Tesma International Inc., Concord (CA)

( * ) Notice: Subject to any disclaimer, the term of this patent is extended or adjusted under 35 U.S.C. 154(b) by 825 days.

(21) Appl. No.: 10/182,082

(22) PCT Filed: Jan. 26, 2001

(86) PCT No.: PCT/CA01/00067

§ 371 (c)(1),
(2), (4) Date: Jul. 25, 2002

(87) PCT Pub. No.: WO01/55597

PCT Pub. Date: Aug. 2, 2001

(65) Prior Publication Data

US 2005/0118018 A1 Jun. 2, 2005

Related U.S. Application Data

(60) Provisional application No. 60/178,205, filed on Jan. 26, 2000.

(51) Int. Cl.
*F04D 15/00* (2006.01)

(52) U.S. Cl. ..... 415/48; 415/131; 415/157

(58) Field of Classification Search ..... 415/17, 415/33, 34, 48, 131, 132, 140, 146, 147, 415/157; 123/41.44–41.47, 41.08–41.01
See application file for complete search history.

(56) References Cited

U.S. PATENT DOCUMENTS

| | | | | |
|---|---|---|---|---|
| 2,341,985 | A | 2/1944 | Green | |
| 4,726,325 | A * | 2/1988 | Itakura | 123/41.1 |
| 4,752,183 | A | 6/1988 | Sakurai | |
| 4,798,517 | A | 1/1989 | Katsumoto et al. | |
| 4,828,454 | A | 5/1989 | Morris et al. | |
| 5,169,286 | A * | 12/1992 | Yamada | 415/48 |
| 6,074,167 | A * | 6/2000 | Olifirov et al. | 415/131 |
| 6,796,766 | B2 * | 9/2004 | Hesse | 415/157 |

* cited by examiner

*Primary Examiner*—Edward K. Look
*Assistant Examiner*—Nathan Wiehe
(74) *Attorney, Agent, or Firm*—Clark Hill PLC

(57) ABSTRACT

A variable flow water pump includes a housing having an impeller mounted on a rotatable shaft. The pump impeller has a plurality, of vanes fixed to a back plate or flange. A circumferentially surrounding shroud is axially movable within the housing and may move between an open position and a covering position to expose or surround the vane portions and therefore control the effective working capacity of the pump. The shroud is controlled by an actuator and shift fork arrangement that responds to sensor measurements of temperature and/or engine speed to supply a sufficient quantity of coolant tailored to the actual need of the engine and without unwanted power loss caused by excessive flow.

4 Claims, 3 Drawing Sheets

VARIABLE FLOW WATER PUMP

RELATED APPLICATION

This patent application is a §371 of PCT/CA01/00067 filed on Jan. 26, 2001, which claims priority to and all the benefits of U.S. Provisional Patent Application No. 60/178, 205, filed on Jan. 26, 2000.

FIELD OF THE INVENTION

The subject invention relates to a variable flow water pump with an impeller and movable shroud for use in automotive engines and the like.

DESCRIPTION OF THE RELATED ART

The cooling mechanism for an internal combustion engine used in an automobile normally comprises a coolant pump, commonly referred to as a water pump, of a centrifugal-type. The most common arrangement utilizes the engine rotation to drive a shaft via a belt connection between a driving pulley (connected to the crankshaft) and a driven pulley. The example shown in FIG. 1 shows a typical water pump 10 with the impeller 20 fastened to a rotating shaft 30 drivable by the pulley 40, which is attached to the engine crankshaft (not shown). The impeller 20 consists of a flange 22 having several integral blades or vanes 24 projecting axially toward the inlet path 26. When the pulley 40 rotates, the drive shaft 30 rotates, and the vanes 24 similarly rotate. Coolant enters the passageway 50 and is thrown outward by centrifugal force to an outlet port (not shown) via the outlet path 28.

Although this system is simple, it has the disadvantage of supplying a fixed capacity of coolant that is often unnecessarily large. This over-capacity arises because the pump output is sized to deliver a minimum flow amount of coolant at low engine speeds. At higher engine speeds, such as those experienced under normal highway driving conditions, the flow amount becomes excessive because it is directly proportional to engine speed, which is up to an order of magnitude greater. This leads to poor cooling efficiencies and increased power losses.

An alternative arrangement uses an electric motor instead of the engine to drive the impeller. However, this adds weight and cost because extra components are required, and because the capacity of the battery and generator needs to be increased, to supply the extra power needed by the motor.

The U.S. Pat. No. 4,094,613 discloses a variable output centrifugal pump utilizing a volute type diffuser in addition to vane diffusers. The variable flow is produced by a telescoping sleeve that closes or opens a main volute diffuser. In this design, a second volute diffuser is always open, so the range of control does not extend to zero flow output. Furthermore, the vane diffusers do not lie in a common plane, which leads to an undesirable increase in the physical volume of the pump.

The U.S. Pat. No. 4,828,455 proposes a variable capacity impeller-type water pump that uses an axially movable thrust shaft and an attached disk or shroud with recesses through which the vanes protrude. A thermostat responds to temperature changes to move the thrust shaft and attached disk or shroud over the vanes to vary the exposed area and therefore the quantity of coolant that flows through the water pump. This design relies on the accuracy of the thermostat, which can be suspect. It also poorly controls flow into the volute, allowing coolant to pass beneath the impeller. Furthermore, it does not allow for varying the pump capacity with the engine rotational speed. It would be advantageous, for example, to reduce the flow capacity during engine startup to reduce engine warm up time.

The U.S. Pat. No. 4,828,454 discloses a variable capacity impeller-type water pump utilizing an impeller for pumping fluid through passageways in the pump and a movable shroud which is axially displaceable for varying the size, and thus, volume capacity of the fluid passing through the passageways.

SUMMARY OF THE INVENTION

The present invention provides a water pump construction with its capacity variable in accordance with an actuator that receives input from multiple sensing devices that measure, for example, coolant temperature, engine block temperature, and engine rotational speed.

According to the present invention there is provided a variable flow coolant pump comprising a pump housing extending along a longitudinal axis defining a fluid chamber and having a fluid inlet and a fluid outlet for providing flow of coolant through the housing An impeller is rotationally supported in the housing between the inlet and the outlet for pumping the coolant through the housing. The impeller has a flange disposed transverse to the longitudinal axis of the housing and at least one vane projecting axially from the flange. A shroud is operatively coupled to the housing and aligned axially with the impeller for movement along the longitudinal axis between an open position spaced axially from the impeller for allowing a maximum amount of fluid flow through the housing between the inlet and the outlet and a covering position disposed at least partially around the impeller vanes for selectively reducing the amount of fluid flow through the housing.

DETAILED DESCRIPTION OF THE PREFERRED EMBODIMENT

Figure 2:
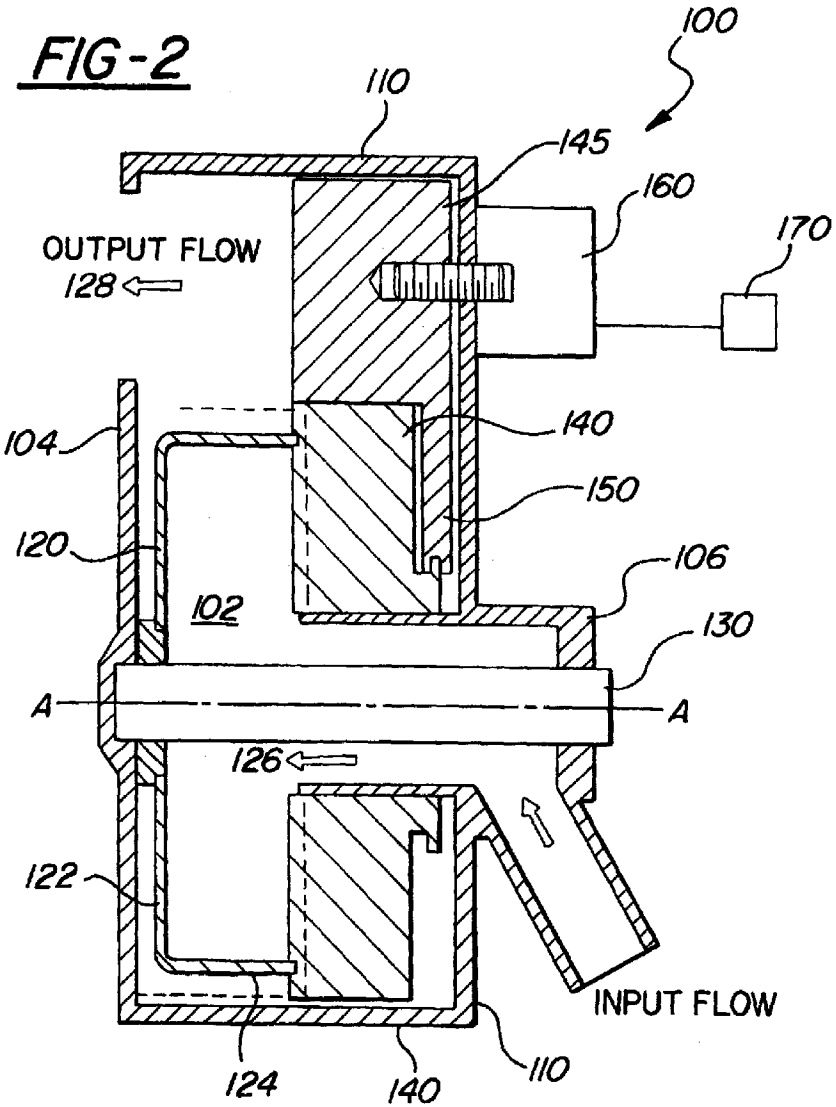
FIG. 2 is a cross-sectional view of a water pump according to the present invention.

Referring to the Figures, wherein like numerals indicate like or corresponding parts throughout the several views, FIG. 2 shows an embodiment of a variable flow coolant pump 100, such as a water pump for an automotive vehicle, comprising a pump housing 110 extending along a longitudinal axis A defining a fluid chamber 102 and having an inlet 126 and an outlet 128 for providing flow of coolant, such as water, between through the housing 110. The housing includes a first end wall 104 and an opposite second end wall 106. The pump 100 further includes an impeller 120. The impeller 120 is fastened to a rotatable shaft 130 drivable by a pulley (not shown) that is belt driven from the engine crankshaft in a well known manner. The shaft 130 is rotatably journaled between the first end wall 104 and the second end wall 106 for supporting the impeller 120 in the housing 110 between the inlet 126 and outlet 128 and rotating the impeller 120 about the longitudinal axis.

The impeller 120 includes a flange 122 disposed transverse to the longitudinal axis A of the housing 110 and a plurality of integral vanes 124 projecting axially from the flange 122 toward the inlet path 126.

Figure 1:
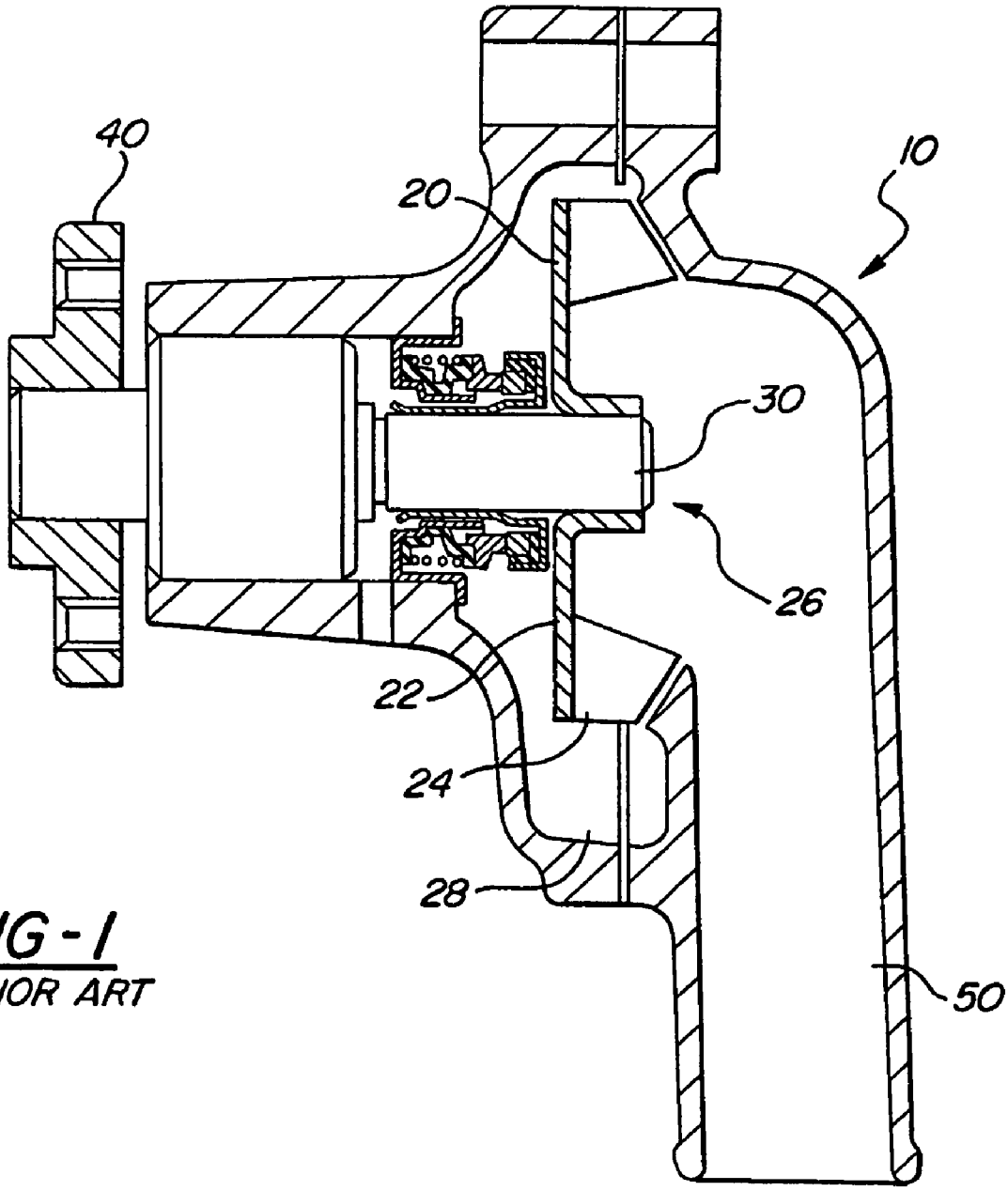
FIG-1 PRIOR ART
FIG. 1 is a cross-sectional view of a prior art water pump.
Figure 3:
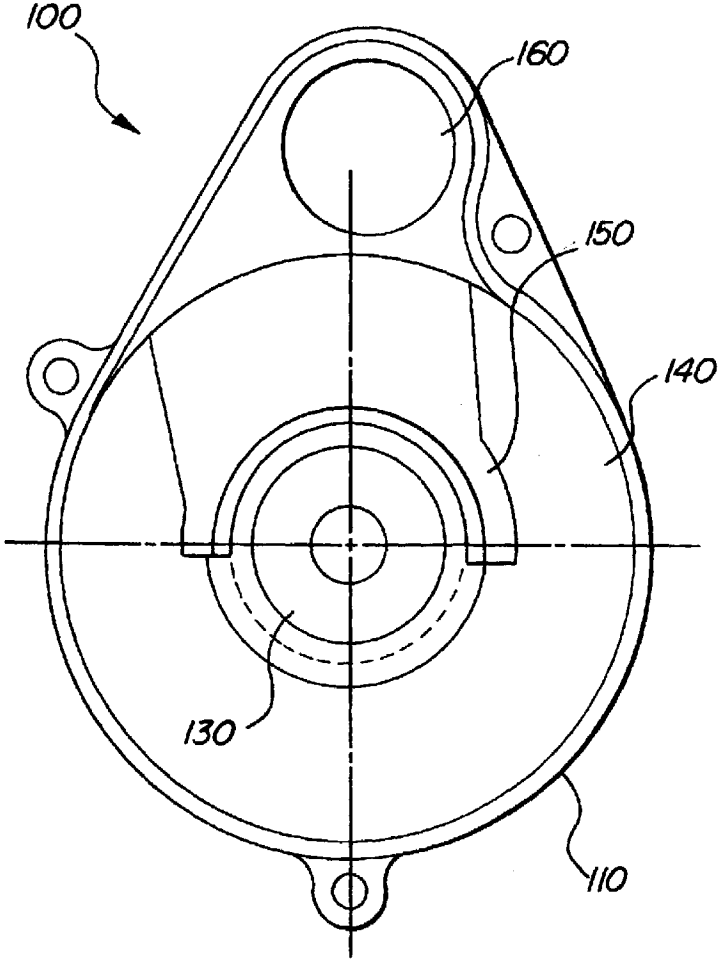
FIG. 3 is a top view of a water pump according to the present invention, and showing the location of the actuator and shift fork.
Figure 4:
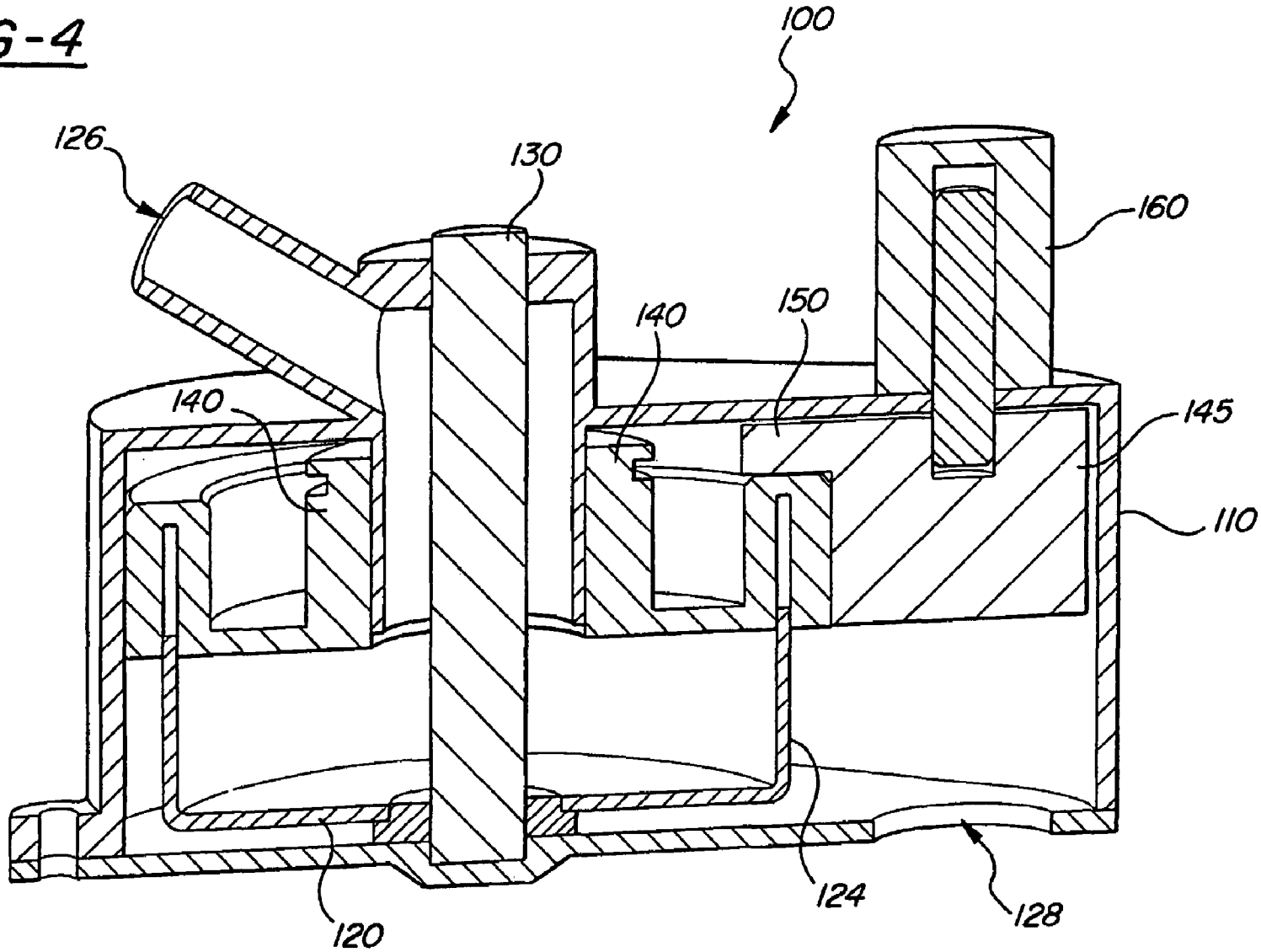
FIG. 4 is a perspective view of the invention.

Further, the pump 100 includes an axially movable shroud 140 operatively coupled to the housing and aligned axially with the impeller 120 for movement along the longitudinal axis A and the shaft 130 between an open position (shown in solid in FIG. 2) spaced axially from the impeller 120 for allowing a maximum amount of fluid flow through the housing 110 and a covering position (shown in phantom in FIG. 2) disposed at least partially around the impeller vanes 124 for selectively reducing the amount of fluid flow through the housing 110. The shroud 140 is circumferentially disposed around the impeller vanes 124, and extending parallel to the axis of rotatable shaft 130, such that the effective or working portion of the impeller 120 is that portion of the vanes 124 that does not extend into the surrounding shroud 140. The shroud 140 is held in place by a shift fork 150 supported by a non-rotating shroud support 145 and controlled by an actuator 160, which may be of any known type, including, but not restricted to, hydraulic and electronic types. The shift fork 150 is best seen in FIGS. 3 and 4. The shroud 140 and adjacent non-rotating shroud support 145 also assist in reducing the overall volume of the fluid chamber 102 in the housing when the actuator 160 and shift fork 150 move the shroud 140 from the open position to the covering position.

The shroud 140 may rotate along with the impeller vanes 124, at either the same rotational velocity, or a different rotational velocity by being keyed to the shaft 130. Alternatively, the shroud 140 may be stationary or a non-rotating shroud.

In operation, when the engine of the vehicle is first started, the shroud 140 will enclose substantially all of the vanes 124 of the impeller 120, which results in no effective pumping action despite the rotation of the impeller shaft 130. This allows the engine to quickly warm up after starting by allowing the heat to accumulate. As the temperature rises, a thermocouple or other sensor 170 sends a signal to the actuator 160 to move the shroud 140 away from the impeller flange 122 and expose vane surfaces 124 to perform centrifugal pumping action. It should be appreciated that the actuator 160 and shaft fork 150 may axially displace the shroud 140 around the impeller 120 and vanes 124 any desired amount to selectively control the fluid flow through the housing 110 and between the inlet 126 and outlet 128.

If so desired, the actuator 160 can also receive signals from an engine speed sensor. When the engine is rotating at high speed, the shroud 140 can be moved over the impeller vanes 124, regardless of the coolant temperature. Accordingly, the effective vane height decreases, reducing the pump capacity when it is not needed.

Having now fully described the invention, many changes can be made by one of ordinary skill in the art without departing from the scope of the invention as set forth herein.

What is claimed is:

1. A variable flow coolant pump comprising: a pump housing extending along a longitudinal axis defining a fluid chamber and having a fluid inlet and a fluid outlet for providing flow of coolant through said housing; an impeller rotationally supported in said housing between said inlet and said outlet for pumping said coolant through said housing, said impeller having a flange disposed transverse to said longitudinal axis of said housing and at least one vane projecting axially from said flange; a shroud operatively coupled to said housing and aligned axially with said impeller for movement along said longitudinal axis between an open position spaced axially from said impeller for allowing a maximum amount of fluid flow through said housing between said inlet and said outlet and a covering position disposed at least partially around said impeller vanes for selectively reducing the amount of fluid flow through said housing; an actuator coupled to said shroud for controlling said axial displacement of said shroud between said open position and said covering position; a shaft rotatably journaled to said housing for supporting said impeller in said housing between said inlet and said outlet and rotating said impeller about said longitudinal axis, said shaft further extending through said shroud; and a shaft fork coupled between said actuator and said shroud for engaging and moving said shroud axially alone said shaft between said open position and said covering position.

2. A variable flow coolant pump as set forth in claim 1 further including a sensor coupled to said actuator for controlling said actuator and said selective displacement of said shroud between said open position and said covering position.

3. A variable flow coolant pump as set forth in claim 2 wherein said sensor is temperature sensor for measuring the temperature of an engine and activating said actuator upon sensing a predetermined engine temperature to displace said shroud between said open and covering positions.

4. A variable flow coolant pump as set forth in claim 2 wherein said sensor is a speed sensor for measuring the speed of an engine and activating said actuator upon sensing a predetermined engine speed to displace said shroud between said open and covering positions.

* * * * *